US007578096B2

(12) United States Patent
Haab et al.

(10) Patent No.: US 7,578,096 B2
(45) Date of Patent: Aug. 25, 2009

(54) APPARATUS FOR MOVABLE SEPARATING ELEMENTS, A DRIVE ASSEMBLY AND A SEPARATING ELEMENT

(75) Inventors: Gregor Haab, Baar (CH); Hans Wüthrich, Wettswil (CH); Cornel Füglistaller, Jonen (CH)

(73) Assignee: Hawa AG, Mettmenstetten (CH)

( * ) Notice: Subject to any disclaimer, the term of this patent is extended or adjusted under 35 U.S.C. 154(b) by 667 days.

(21) Appl. No.: 10/519,982

(22) PCT Filed: Jun. 13, 2003

(86) PCT No.: PCT/CH03/00383

§ 371 (c)(1),
(2), (4) Date: Feb. 11, 2005

(87) PCT Pub. No.: WO2004/005656

PCT Pub. Date: Jan. 15, 2004

(65) Prior Publication Data

US 2005/0160843 A1 Jul. 28, 2005

(30) Foreign Application Priority Data

Jul. 5, 2002 (CH) ..... 1192/02

(51) Int. Cl.
*E05D 15/06* (2006.01)
*E05F 15/14* (2006.01)

(52) U.S. Cl. ..... 49/409; 49/358; 74/89.17; 310/83; 16/87 R; 16/90; 16/94 R

(58) Field of Classification Search ..... 74/29, 74/30, 31, 89.17, 89.18, 89.19; 160/196.1; 49/457, 358, 409; 310/83; 16/90, 94 R, 16/87 R See application file for complete search history.

(56) References Cited

U.S. PATENT DOCUMENTS

| | | | | | |
|---|---|---|---|---|---|
| 3,331,428 | A * | 7/1967 | Ford | 160/331 |
| 4,991,257 | A * | 2/1991 | Eutebach | 16/87 R |
| 6,082,053 | A * | 7/2000 | Bischof et al. | 52/64 |
| 6,098,695 | A * | 8/2000 | Schwingle | 160/199 |
| 6,233,878 | B1 * | 5/2001 | Krahenbuhl et al. | 52/64 |
| 6,286,258 | B1 * | 9/2001 | Bischof et al. | 49/127 |
| 6,516,566 | B2 * | 2/2003 | Finke | 49/127 |

FOREIGN PATENT DOCUMENTS

| | | | |
|---|---|---|---|
| CH | 692 052 | A5 | 1/2002 |
| DE | 2910185 | A * | 9/1980 |
| DE | 82 04 429 | U | 9/1982 |
| DE | 199 32 891 | A1 | 1/2001 |
| EP | 0 959 219 | A2 | 11/1999 |

* cited by examiner

*Primary Examiner*—Richard WL Ridley
*Assistant Examiner*—Thomas Diaz
(74) *Attorney, Agent, or Firm*—Oliff & Berridge, PLC

(57) ABSTRACT

The invention relates to a device for operating an optionally rotatable and parkable divider element which may be displaced in a linear and/or curved manner, fixed to at least two running gears, provided with support rollers which run in a running track, of which at least the first running gear is provided with a drive shaft arranged in a direction perpendicular to the running direction thereof, by means of which a drive wheel may be rotated which engages in a toothed element arranged along an inner wall of the running track. According to the invention, the first running gear is provided with an electric motor, arranged between the support rollers, the motor shaft of which is fixed to the drive shaft.

10 Claims, 6 Drawing Sheets

APPARATUS FOR MOVABLE SEPARATING ELEMENTS, A DRIVE ASSEMBLY AND A SEPARATING ELEMENT

BACKGROUND

The invention relates to an apparatus for driving moveable separating elements.

Glass walls or wooden walls, slotted links, doors or shutters are frequently used to separate or form rooms or to close off room or window openings, and these are referred to in the following text as separating elements which are permanently installed or are attached to drive assemblies which can be moved along a guide rail and, if required, are mounted such that they can rotate and/or can be stacked.

[1], DE 29 10 185 A1, discloses a drive apparatus for a separating element, in which a drive assembly which is used to support the separating element and is guided in a mounting apparatus or on a guide rail is connected to an electric motor which is aligned within and along the guide rail and engages by means of a transmission with a gearwheel in a toothed rod profile, preferably a toothed belt, which is provided in the guide rail. The transmission is connected to an angled piece which is provided with supporting rollers on both sides and is connected to the separating element. The separating element which is described in [1] and which is supported only by a larger drive assembly formed by the angled piece and supporting rollers can be moved only along a straight line, thus ensuring that the gearwheel and the toothed rod profile are always engaged with one another. The described drive apparatus is therefore not suitable for separating elements which can be rotated and which, if required, can be parked.

[2], EP 0 957 208 A1, discloses a drive apparatus in which an electric motor which is connected to the drive assembly is likewise arranged within the guide rail that is used to support the drive assemblies. In this drive apparatus, an electric motor which drives the supporting rollers of the drive assembly is associated via a transmission with a drive assembly for a separating element. On the one hand, this results in a drive based on the power-transmitting connection between the supporting rollers and running surfaces which are provided within the guide rail, for which reason relatively rapid wear of the supporting rollers must be expected, possibly as well as disturbing slip phenomena. Furthermore, particularly due to the transmission that is required to drive the supporting rollers, result relatively large dimensions of the drive apparatus and the guide rail that is used. Furthermore, in the case of the apparatus in [2], it should be noted that a drive shaft in each case having two supporting rollers is driven, which are guided on running surfaces that are separate from one another, thus possibly resulting in undesirable restrictions to the applicability of the apparatus. For example, it is virtually impossible to park the separating elements which are provided with the drive apparatus as disclosed in [2].

Owing to the described problems, the electric motor for the drive apparatus in various more recent developments has been arranged away from the guide rail.

[3], WO 97/42388, discloses a drive apparatus in which a drive assembly is connected to a leading or lagging holder which has its own supporting roller and holds the electric motor at the side and underneath the guide rail such that a gearwheel which is driven by the electric motor can engage from underneath in a toothed belt which is provided in a groove in the guide rail. A relatively large amount of space must therefore be kept free alongside the guide rail for this drive apparatus, and this is often impossible. A cover may need to be provided in order to prevent the electric motor having a disturbing visual effect. According to [4], CH 692 052 A5, the electric motor for this drive apparatus can preferably be mounted such that it can be moved in order to ensure easy, disturbance-free movement of the separating elements on curves or bends in the guide rail, as well.

[5], EP 0 953 706 A1, describes a sliding stacking wall, which has also been developed by the same applicant, in which, as shown in FIG. 1 below, each of the wall or separating elements 3 is bounded at its upper edge close to the ceiling by a horizontally running supporting profile 2, which is connected to two drive assemblies 100*a*, 100*b* which are guided in a guide rail 1. Each of the separating elements 3 has its own drive apparatus 70, which is provided with an electric motor 71 and is arranged within the supporting profile 2, and which (possibly via a transmission 72 which is arranged within the motor housing, an angle transmission 73 and a drive shaft 76) drives a gearwheel 125 which engages in a toothed belt 24 that is arranged within the guide rail 1. Arranging the electric motor 71 parallel to the longitudinal axis of the supporting profile 2 results in the guidance and drive apparatus having a compact configuration without any need to significantly enlarge the cross-sectional area of the supporting profile 2 which, for example, is intended to hold a glass pane.

The attachment of the drive apparatus to the separating element in the case of the solution described in [5] thus requires a correspondingly designed supporting profile 2. Apparatuses for point attachment of elements which can be moved and, possibly, which can be rotated; for example glass panes, metal plates or wooden panels—as are described in [6], WO 98/59140, therefore cannot be used in conjunction with the solution in [5].

SUMMARY

The present invention is therefore based on the object of providing a drive apparatus in particular for separating elements which can be moved linearly or on curves and which, if required, can be rotated and parked, which is not subject to the disadvantages described above. A further object is to specify a separating element, and a drive assembly which is provided with this drive apparatus.

One particular aim is to provide a drive apparatus which is physically compact and can be inserted into guidance apparatuses (which comprise rails, drive assemblies and attachment elements) with reduced dimensions overall.

Furthermore, the drive apparatus according to the invention should be more efficient, and it should be possible to produce it at a lower cost.

In addition, it should be possible to install the drive apparatus according to the invention more easily, and to maintain it with reduced effort.

This object is achieved by a drive apparatus, by a drive assembly and by a separating element. Advantageous refinements of the invention are also provided.

The drive apparatus according to the invention is used to drive a separating element which can be moved linearly and/or on curves and which, if required, can be rotated and parked, and which is attached to at least two drive assemblies, which are guided in a guide rail and are provided with supporting rollers, at least the first of which is provided with a drive shaft which runs at right angles to the running direction of the drive assemblies, and by means of which a drive wheel can be rotated, which engages in a toothed element that is arranged along an inner wall of the guide rail.

According to the invention, the first drive assembly is provided with an electric motor which is arranged vertically between the supporting rollers and whose motor shaft is coupled to the drive shaft such that they rotate together. This results in a simple configuration of the drive apparatus and the avoidance of transmission apparatuses which are specific to a drive assembly, for example an angled drive, as is used in the apparatus described in [5]. In addition to reduced production, installation and maintenance effort, this also results in a more efficient drive apparatus. The body of the first drive assembly is thus at the same time used to hold the supporting and guide rollers and as a holder for the electric motor which is arranged at right angles to the running direction of the drive assembly, thus resulting in the drive assembly being more compact, with a relatively short spacing between the axes of the supporting rollers. Separating elements provided with the drive apparatus according to the invention may be parked without any problems owing to the relatively short distance between the axes of the supporting rollers, since the drive assemblies, which are provided with the drive apparatuses, can be moved close to one another in the parking area. Furthermore, there is no need for any additional holders for the electric motor, which are arranged in a leading or lagging form for known drive assemblies. This also avoids problems with buffer apparatuses which are used as standard and act as end stops in order to stop the separating elements and, as described in [6], WO 00/55460, by way of example, are used to act on the drive assembly body.

Furthermore, the drive apparatus according to the invention allows the use of electric motors which are produced in large quantities as standard, and which may be provided with a transmission integrated in the motor housing. The electric motor and the transmission can thus be matched to one another, can be procured as a single unit at a correspondingly low item price, and can be installed in a drive assembly.

The motor shaft of the electric motor is preferably at the same time used as the drive shaft, to which the drive wheel is fitted. The drive shaft and the motor shaft are in this case manufactured integrally, thus resulting in the apparatus being physically simple. It is also possible to use a coupling apparatus which is preferably formed on the basis of flanges which can be connected to one another, and by means of which the motor shaft and the drive shaft are connected to one another.

An attachment element which is used for holding the separating element is preferably connected to the body of the first drive assembly or to the drive shaft such that it can rotate, or is mounted such that it can rotate within the mounting apparatus that is connected to the separating element, such that the separating elements can rotate, for example when passing over curved rail areas, when a separating wall formed by the separating elements is folded, or when parking the separating elements.

In one preferred refinement of the invention, the drive shaft is screwed to a first flange element which is in the form of a hollow cylinder and is used for bearing a second flange element, which is in the form of a hollow cylinder, is provided with an inner flange at one end and can be connected to the attachment element. The external diameter of the first flange element is at least approximately of the same size as the internal diameter of the second flange element, so that the second flange element can be rotated with little play, or none at all, about the first flange element, and is supported by it, by means of the inner flange. In order to avoid friction between them, lubricants or bearing elements such as balls or rollers may be provided between the two flange elements.

In a further preferred refinement of the invention, the motor shaft, the drive shaft and the attachment element are manufactured integrally, thus resulting in the first drive assembly according to the invention being particularly simple and robust.

If the attachment element is connected to the drive shaft, the load of the separating element is transmitted to it. The motor shaft or the drive shaft is thus preferably mounted vertically in the body of the first drive assembly, for example by means of a flange connected to it, such that forces which act are absorbed by the separating element.

For mutual stabilization of the drive assembly and of the drive apparatus, the motor shaft is, if required, mounted by means of the body of the first drive assembly at one end or at both ends of the electric motor, and is thus held aligned vertically.

The drive assembly preferably has an integral body for accommodating and for holding the electric motor. However, it is also possible to use a body provided with two parts for this purpose, in which, by way of example, the control electronics can also be accommodated.

The drive apparatus according to the invention can be integrated in different types of drive assemblies. The invention can be used particularly advantageously in drive assemblies which are provided with running rollers and guide rollers at only one end, and which are preferably used for separating elements which can be parked, in which the first drive assembly follows one rail side and the second drive assembly follows the other rail side, which may diverge from one another in a parking area.

A busbar which extends in the longitudinal direction of the guide rail is arranged within the guide rail in order to supply power to the electric motor, and is tapped by current collectors which are arranged on the first or second drive assembly of the separating element. The busbar is preferably arranged at the top on the center piece of the guide rail, and is tapped by the current collectors which are arranged on the upper face of the first or second drive assembly.

A control unit which is connected to the current collectors and to the electric motor and to which control signals can be supplied via the busbar is arranged on the first or second drive assembly, and is preferably integrated in it.

BRIEF DESCRIPTION OF THE DRAWINGS

The invention will be explained in more detail in the following text with reference to drawings, in which.

DETAILED DESCRIPTION OF THE EMBODIMENTS

Figure 1:
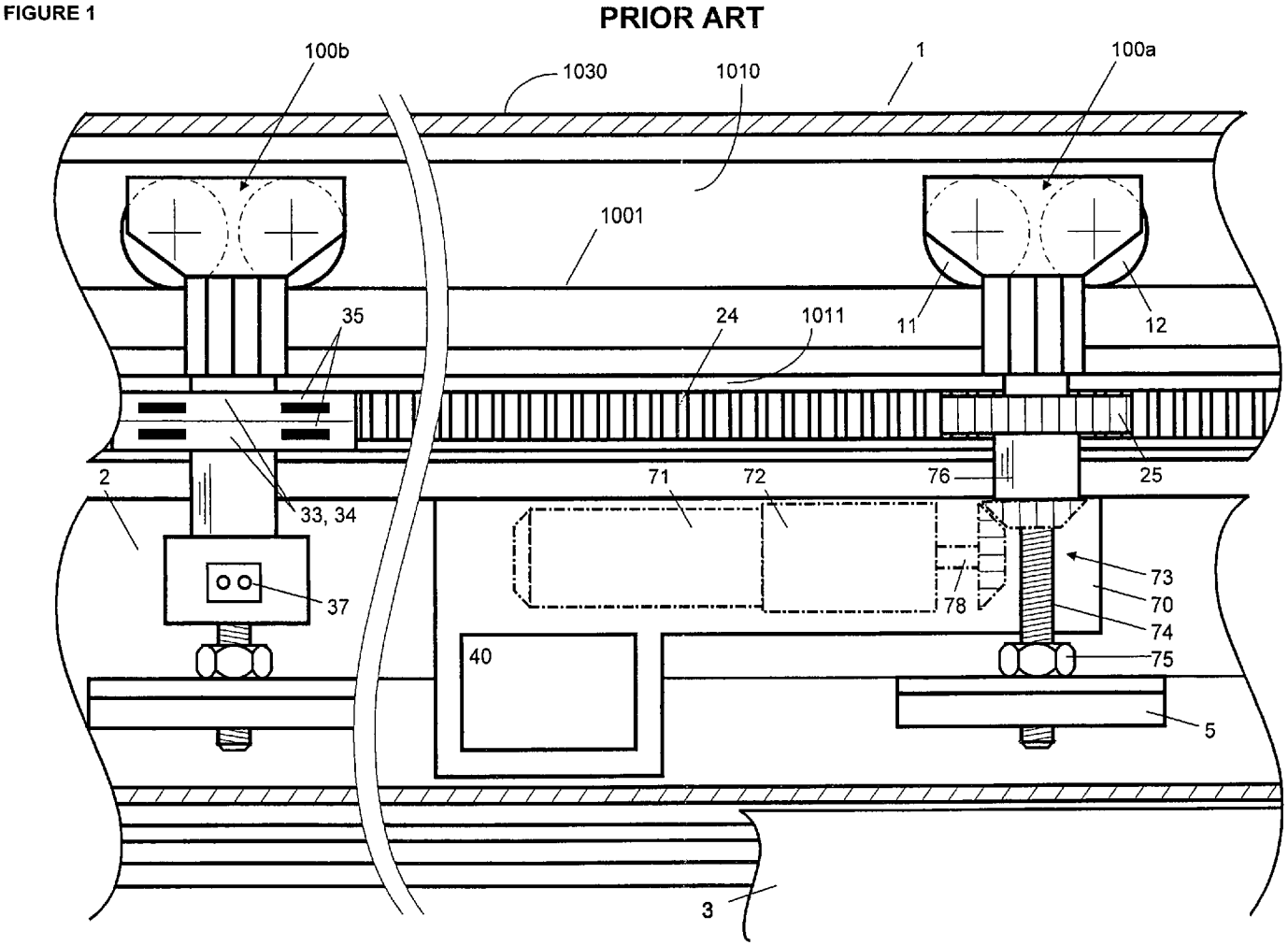
FIG. 1 shows a known drive apparatus for a moveable separating element 3 which can rotate, having a supporting profile 2 in which an electric motor is arranged.

FIG. 1, below, shows the drive apparatus known from [5] with two drive assemblies 100*a*, 100*b* which are guided on a running surface 1001 in a guide rail 1 and are connected by means of connecting screws 74, threaded nuts 75 and sliding blocks 5 to a supporting profile 2, by means of which a separating element 3 is held. The guide rail 1 which is shown in the section illustration has a center piece 1030 and two side pieces 1010, 1020, which form a U-profile. The second side piece 1020 is cut away in FIG. 1.

The first drive assembly 100*a* is connected to a drive module 70, which is arranged within the supporting profile 2 and requires an appropriate amount of free space in it. The drive module 70 has an electric motor 71, which is controlled by a control unit 40, and has a transmission 72 (which may be integrated in it) as well as an angled transmission 73, which is connected on the one hand to the motor shaft 78 (which is aligned parallel to the longitudinal axis of the supporting profile 2) of the electric motor 71, and on the other hand to a hollow-cylindrical drive shaft 76 which surrounds the associated connecting screw 74 and is aligned at right angles to the running surface 1001. A drive wheel 25 is fitted to the drive shaft 76 and engages in a toothed belt 24, which is arranged in a drive groove 1011 that is provided in the first side piece 1010 of the guide rail 1.

Figure 6:
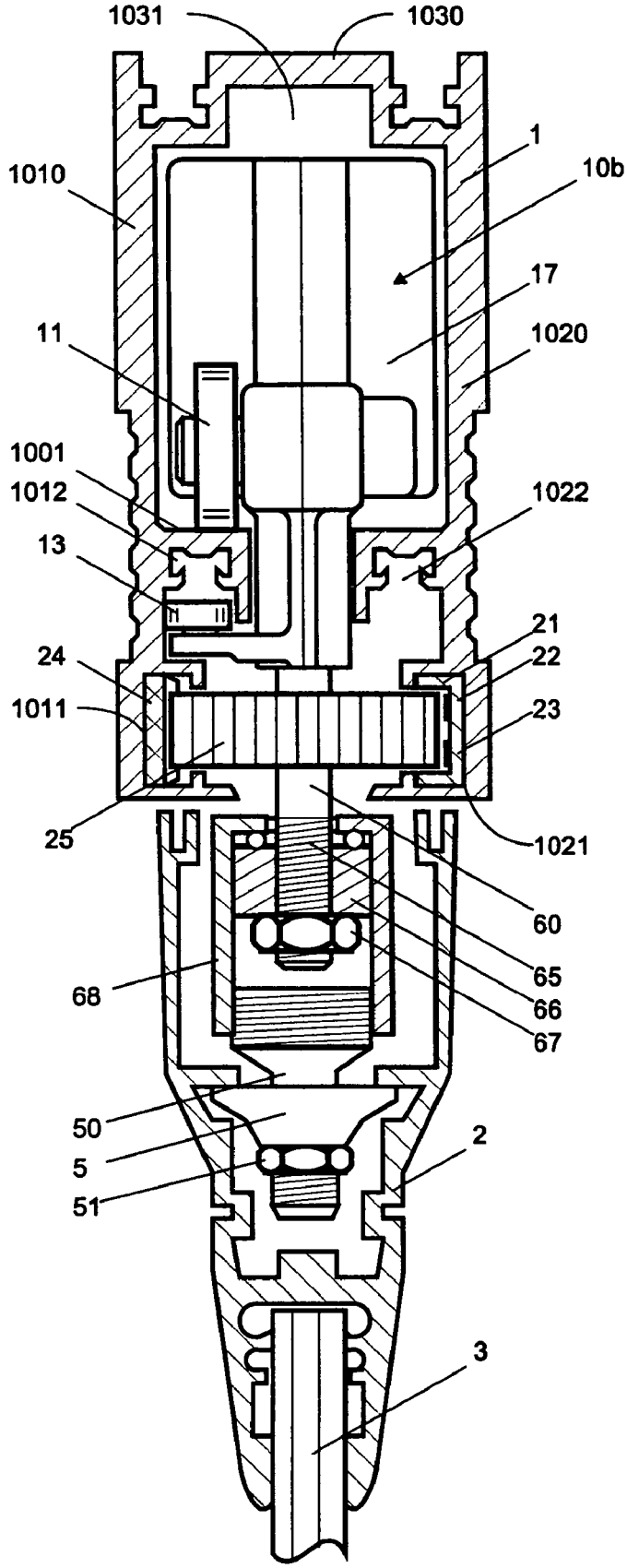
FIG. 6 shows a side view of the guide rail 1 with the drive assembly 10*b* as shown in FIG. 3 guided in it.

The second drive assembly 100*b* is provided with current collectors 33, 34 which have contacts 35 to tap the conductors 22, 23 on a busbar 21, which is arranged in a busbar groove 1021 that is provided in the second side piece 1020 of the guide rail 1 (see also FIG. 6). The connection of the contacts 35, which are supported by springs 36, to the control unit 40, by means of which signals which are transmitted via the busbar 21 are decoded and are converted in an appropriate form to electrical power, is made via a connecting plate 37 and connecting cables which are laid within the supporting profile 2 (not shown).

The disadvantages of this apparatus, in particular the requirement for a supporting profile 2 with a corresponding physical volume, the transmission losses caused by the angled transmission 73 and the complex design of the apparatus, have been described in the introduction.

Figure 2:
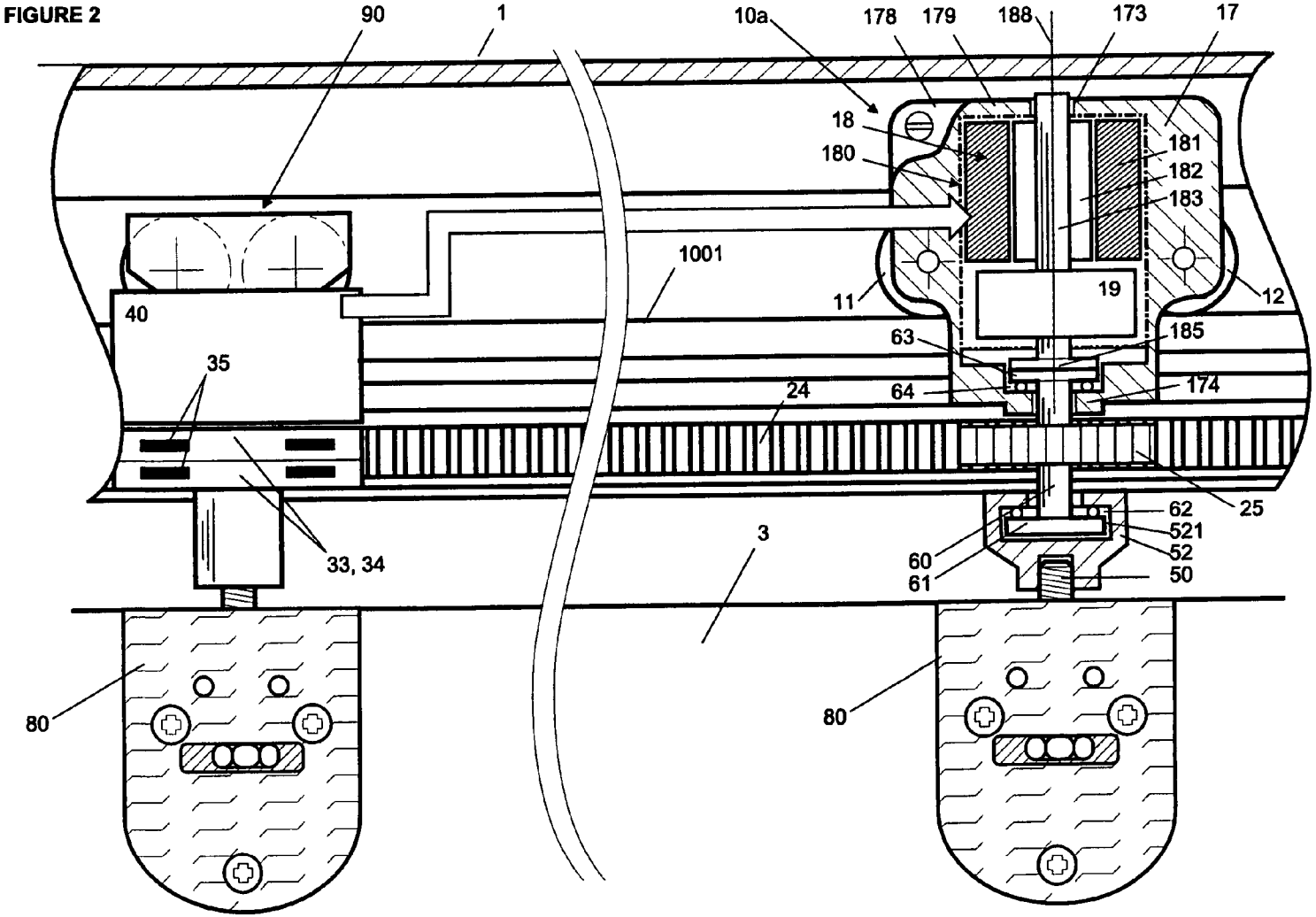
FIG. 2 shows a drive apparatus according to the invention for a moveable separating element 3 which can rotate and is connected to a drive assembly 10*a* in which an electric motor 18 is integrated.

As a preferred refinement, FIG. 2 shows a drive apparatus according to the invention for a moveable separating element 3 which can rotate and can be parked, and which is connected by means of mounting apparatuses 80 provided at specific points, as described in [6], to a first and a second drive assembly 10*a*, 90. The profiled strip 2 that is shown in FIG. 1 is thus not required; however, it may likewise be used, by way of example, with reduced dimensions (see FIG. 6).

The first drive assembly 10*a* is, according to the invention, provided with an electric motor 18 which is arranged at right angles between the supporting rollers 11, 12, has a stator 181 and a rotor 182, and whose motor shaft 183 is coupled to a drive shaft 60 such that they rotate together. The body 17 of the first drive assembly 10*a* is thus at the same time used to hold supporting and guide rollers 11, 12, 13, 14 (see FIG. 5) and as a holder for the electric motor 18 which is arranged at right angles to the running direction of the drive assembly 10*a*, thus resulting in the first drive assembly 10*a* being physically compact.

In the preferred refinement which is shown in FIG. 2, an electric motor 18 is inserted into the first drive assembly 10*a*, in whose motor housing 180 a transmission 19 is integrated, by means of which the torque transmitted to a drive wheel 25 is set as required. The drive wheel 25 in this case engages, as is shown in FIG. 6, in a toothed belt 24 which is provided within the guide rail 1.

In order to accommodate and to hold the electric motor 18, the first drive assembly 10*a* has two parts 178, 179, which can be screwed to one another and between which the electric motor 18 is installed. Bearing shells are preferably provided at connecting points between the two parts 178, 179 and form axial bearings 173 or axial and supporting bearings 174, which are used to bear the motor shaft 183 and/or the drive shaft 60. The body of the first drive assembly 10*a* may, however, also be manufactured integrally, of course.

An attachment apparatus having a helical attachment element 50 (which is held by the mounting apparatus 80) and a connecting part 52 (which is connected to the drive shaft 60 such that it can rotate) is provided in order to hold the separating element 3. For this purpose, the drive shaft 60 has a flange 61 which is held by means of bearing elements 62 within a bearing area 521, which is provided in the connecting element 52, such that it can rotate. The separating elements can thus rotate without any impairment, for example when passing over curved rail areas, when folding a separating wall formed by the separating elements, or when parking the separating elements.

The load which acts on the drive shaft 60 from the separating element 3 is transmitted to the body 17 of the first drive assembly 10*a* by means of a second flange 63, which is arranged on the drive shaft 60. For this purpose, the body 17 is provided with a supporting bearing 174 and with bearing elements 64 arranged in it, on which the flange 63 is supported. No forces caused by the separating element 3 that is supported by the drive assemblies 10*a*, 10*b* are therefore transmitted to the motor shaft 183 of the electric motor 18, which is coupled by means of its own flange 185 to the second flange 63 of the drive shaft 60, so that the electric motor 18 can be installed in a simple form, essentially such that it rotates with the shaft. Furthermore, it is possible for the motor shaft 183 to be borne underneath the electric motor 18, analogously to the bearing illustrated for the flange 63, or above the electric motor 18, as is particularly advantageous, especially when the motor shaft 183 and the drive shaft 60 are formed integrally. The forces exerted by the separating element 3 are in this case transmitted via the motor shaft 183 to the body 17 of the first drive assembly 10*a*.

As in the case of the system illustrated in FIG. 1, the electrical power is supplied to the drive apparatus by means of a busbar 21, which is provided in the guide rail 1 and is tapped by means of contacts 35 of current collectors 33, 34, which are connected to a control unit 40 which, according to the invention, is arranged on the second drive assembly 90 within the guide rail 1, and is connected to the drive apparatus by means of connecting lines which are routed within the guide rail 1. This type of electrical power supply is, however, not very suitable for systems with separating elements which can be parked. As is described in the following text in conjunction with FIGS. 7 and 8, the current collectors 33, 34 are preferably arranged on the first drive assembly 10*a*.

Figure 3:
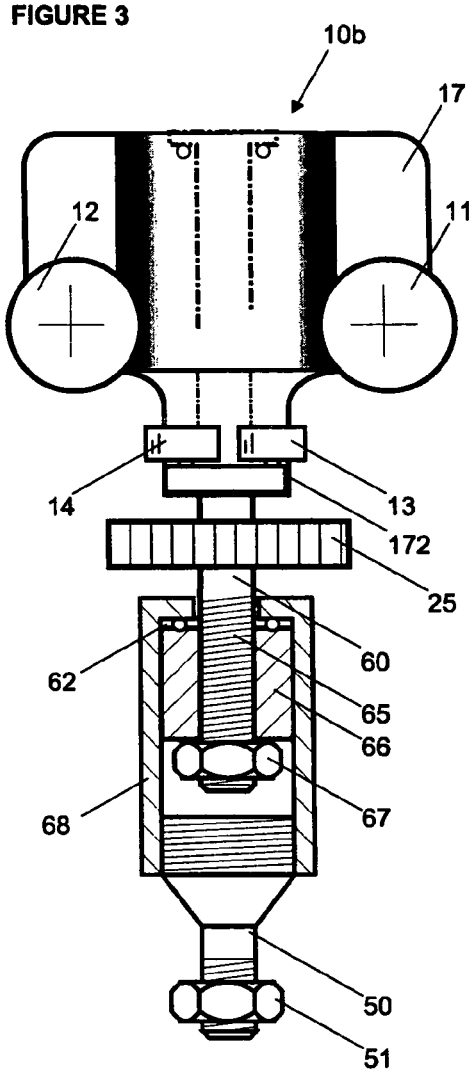
FIG. 3 shows a drive assembly 10*b* according to the invention with an integrally manufactured motor and drive shaft 60, 183, which is connected to an attachment element 50, which is used to hold the separating element 3, by means of a connecting apparatus such that it can rotate.

FIG. 3 and FIG. 6 show a further drive assembly 10*b* according to the invention, with an integrally manufactured motor and drive shaft 60, 183, which is connected to an attachment element 50 (which is used to hold the separating element 3) by means of a connecting apparatus such that it can rotate. In this preferred refinement of the invention, the drive shaft 60 (which is provided with a thread 65) is screwed to a first hollow-cylindrical flange element 66, which is used to bear a second hollow-cylindrical flange element 68, which is provided with an inner flange at one end and can be connected to the attachment element 50, which is provided with a threaded nut 51. The external diameter of the first flange element 66, which is secured by means of a threaded nut 67, is at least approximately of the same size as the internal diameter of the second flange element 68, so that the second flange element 68 can rotate with little play, or no play at all, about the first flange element 66, and is supported by it, by means of the inner flange. In order to avoid friction between them, bearing elements 62 are also provided between the flange elements 66, 68. In this case, it is particularly advantageous that this physically simple connecting apparatus can be installed quickly and without any problems.

In addition to the supporting rollers, FIG. 3 also shows two guide rollers 13, 14, which are mounted on a vane 172 (which is provided with the body 17 of the first drive assembly 10*a*; 10*b*), and are guided in a first guide groove 1012 (which is provided in the first side piece 1010). The guide rollers 13, 14 of the second drive assembly 90 are normally guided in a second guide groove 1022, which is provided in the second side piece 1020, particularly in the case of separating elements 3 which can be parked.

Figure 4:
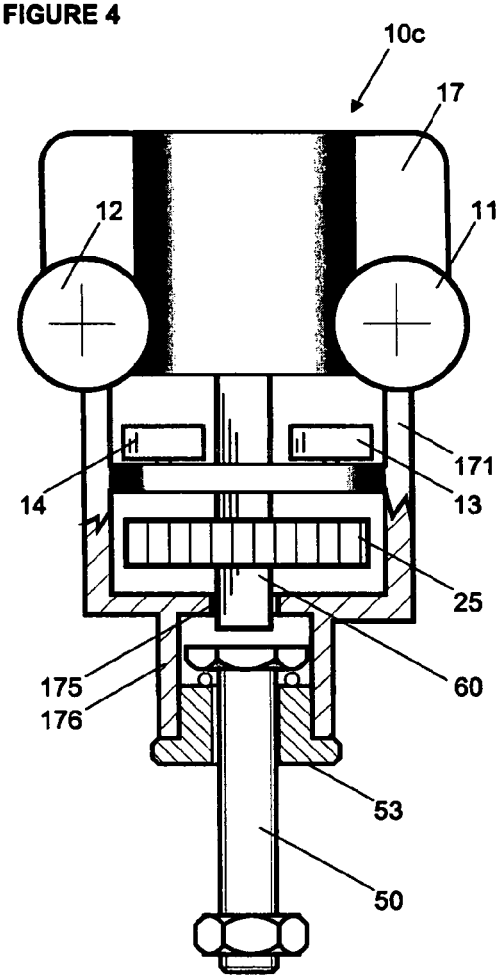
FIG. 4 shows a drive assembly 10*c* according to the invention, whose body 17 is connected to the attachment element 50 that is used to hold the separating element 3.

FIG. 4 shows a drive assembly 10*c* according to the invention, whose body 17 is connected to the attachment element 50, which is used to hold the separating element 3. The body 17 of the drive assembly 10*c* is provided with a frame 171 that is used to bear the drive shaft 60 and to bear the drive shaft 60, and has a mounting ring 176 provided underneath the drive shaft 60. An insert 53 can be inserted into the mounting ring 176, and if required can be screwed into it, and is provided axially with a hole that is used to accommodate the attachment element 50. The attachment element 50, which is mounted on the insert 53 by means of bearing elements such that it can rotate, is in this case a simple connecting screw, which can be connected without any problems to different types of mounting apparatuses 80 that are attached to the separating element 3. The attachment element 50 may also be borne in the same way in the mounting apparatus 80 (see, for example, FIG. 5).

Figure 5:
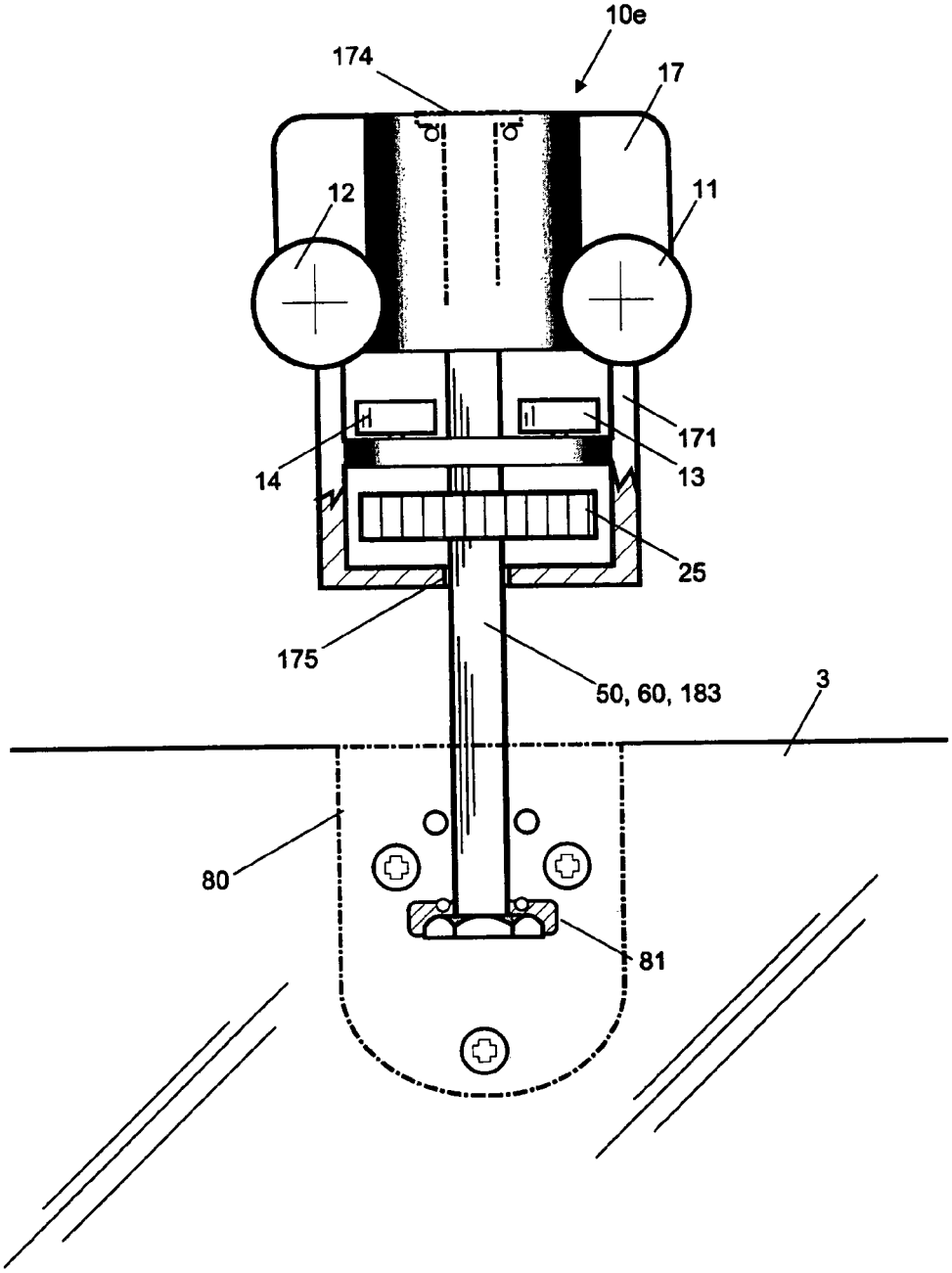
FIG. 5 shows a drive assembly 10*e* according to the invention, with an integrally manufactured motor shaft 183, drive shaft 60 and attachment element 50.

In the drive assembly 10*e* shown in FIG. 5, the motor shaft 183, the drive shaft 60 and the attachment element 50 are manufactured integrally and are borne at one end in the mounting apparatus 80 and at the other end in the body of the drive assembly 10*e*, in supporting bearings 81, 174 such that they can rotate, so that the forces which originate from the supporting element 3 are transmitted to the drive assembly 10*e* (see also FIG. 6).

Figure 7:
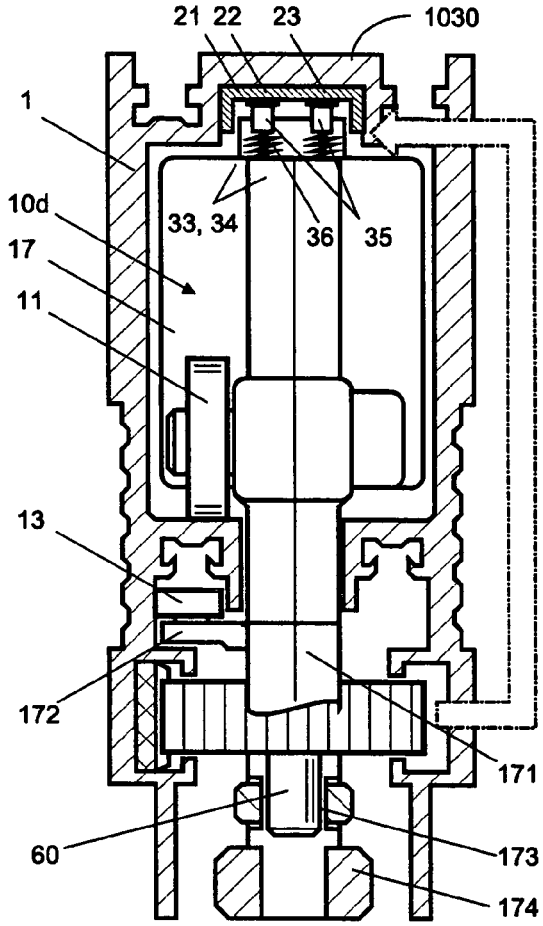
FIG. 7 shows a side view of the guide rail 1 with a busbar 21 attached to the center piece 1030 at the top, and with a drive assembly 10*d*, which is guided in the guide rail 1 and has current collectors 33, 34 on the upper face of the drive assembly body 17*c*.

As described above, the current collectors 33, 34 which are used for tapping the busbar 21 are preferably arranged on the first drive assembly 10*a*, . . . , 10*e*, which is provided with the drive apparatus. FIG. 7 shows a drive assembly 10*d* according to the invention, whose current collectors 33, 34 are arranged on the upper face of the body 17 of the drive assembly 10*d* and tap a busbar 21, which is arranged in a busbar groove 1031 provided in the center piece 1030 of the guide rail 1. This refinement of the drive assembly according to the invention has many advantages. No electrical leads are required between the drive assembly 10*d* according to the invention and the further drive assembly 90 which is connected to the separating element 3, so that the two drive assemblies 10*d*, 90 can be moved on curved paths, which may be separated from one another, on the horizontal plane, which is particularly advantageous in the case of systems in which the separating elements 3 can be parked in one area. It is also advantageous that only short connecting lines are required, thus reducing the material costs and the transmission losses. Furthermore, installation and maintenance are simplified, since the drive assembly 10*d* together with the control unit 40 integrated in it forms an autonomous unit.

Figure 8:
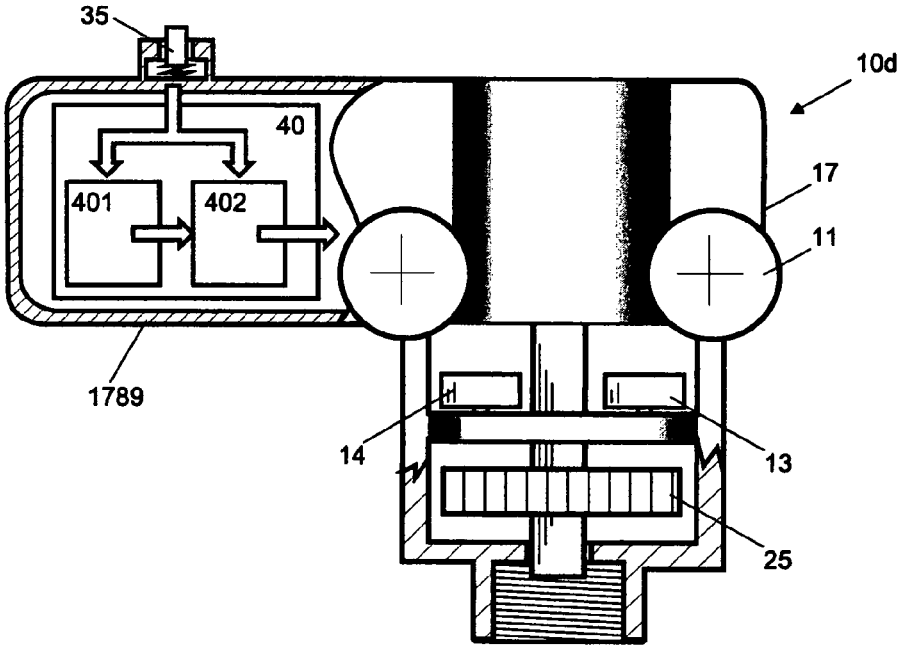
FIG. 8 shows the drive assembly 10*d*, whose body 17 is provided with an extension 1789 that is used to accommodate a control unit 40.

FIG. 8 shows the drive assembly 10*d* with the control unit 40 integrated in it, and comprises a decoding unit 401 and a drive unit 402. In the refinement shown in FIG. 8, the control unit 40 is arranged within a vane-like extension 1789 on the body 17 or on the housing 178, 179 of the drive assembly 10*d*, which is designed such that it does not impede the mutual movement between drive assemblies 10*a*, 10*b*, 10*c*, 10*d*, 10*e* to be parked, or partially overlaps the adjacent drive assembly 10*d*. This is possible in particular in the case of drive assemblies in which the supporting and guide rollers 11, 12, 13, 14 are arranged on only one side of the drive assembly, so that there is correspondingly more free space on the other side.

In a further preferred refinement of the invention, the control unit 40 as well as the other motor electronics are provided on a flexible circuit, thus making optimum use of the small amount of space available within the guide rail, or making it possible to reduce the dimensions of the drive motor and/or of the drive assembly housing in a corresponding manner. Flexible circuits are produced, for example, by Sheldahl (see www.sheldahl.com). This can be done, for example, using the Sheldahl "Density Patch™" product for system and motor control, which can advantageously be integrated in the drive assembly 10 according to the invention.

The drive apparatus according to the invention and drive assemblies 10*a*, . . . , 10*e* provided with this drive apparatus, as well as separating elements 3, have been described and illustrated using preferred refinements. However, further specialist refinements can be produced on the basis of the teaching according to the invention. In particular, different forms of the body of the drive assembly, different refinements of the motor shaft, of the drive shaft, of the attachment element and of the associated bearing parts are feasible.

The invention claimed is:

1. An apparatus for driving a separating element that can be moved linearly and/or on curves and that, if required, can be rotated and parked, the apparatus comprising:

at least first and second drive assemblies attached to the separating element, the first and second drive assemblies including supporting rollers, the first drive assembly including a drive shaft that is aligned at right angles to a running direction of the first drive assembly, an electric motor coupled thereon, and a drive wheel rotated by the motor; and a guide rail on which the supporting rollers are guided, the guide rail comprising a center piece and two side pieces, running surfaces provided on the side pieces for the supporting rollers, and a toothed element attached to and arranged along an inner wall of the guide rail, wherein the drive wheel is rotated and engages in the toothed element, wherein the electric motor is mounted on the first drive assembly in such a way that the electric motor is guided above the running surfaces in an accordingly dimensioned space within the guide rail with the axis of the motor shaft being aligned between the supporting rollers at right angles to a plane that is defined by the running surfaces, the motor shaft is firmly coupled via a transmission to the drive shaft that is aligned in parallel to the axis of the motor shaft, the separating element is connected to the driving apparatus by means of an attachment element, that is held by a body of the first drive assembly and in parallel to the separating element, and a busbar extending in the longitudinal direction of the guide rail is arranged within the guide rail and is tapped by current collectors that are arranged on the first drive assembly.

2. The drive apparatus as claimed in claim 1, wherein the electric motor is arranged in a motor housing in which the transmission is also integrated.

3. The drive apparatus as claimed in claim 1, wherein the shaft of the transmission and the drive shaft are integrally connected to one another.

4. The drive apparatus as claimed in claim 1, wherein the attachment element is rotatably connected to the body of the first drive assembly.

5. The drive apparatus as claimed in claim 1, wherein the motor shaft is mounted by means of the body of the first drive assembly at one end or at both ends of the electric motor.

6. The drive apparatus as claimed in claim 1, wherein the body of the first drive assembly has two parts which surround the electric motor, or the first drive assembly has an integral body which is suitable for accommodating and for holding the electric motor.

7. The drive apparatus as claimed in claim 1, wherein at least one of guide rollers or said supporting rollers are mounted at one end or at both ends of the first drive assembly.

8. The drive apparatus as claimed in claim 1, wherein the busbar is arranged at the top on the center piece of the guide rail, and is tapped by the current collectors which are arranged on the upper face of the first or second drive assembly.

9. The drive apparatus as claimed in claim 1, wherein a control unit which is connected to the current collectors and to the electric motor is arranged on the first or second drive assembly.

10. The drive apparatus as claimed in claim 9, wherein the control unit, which is preferably in the form of a flexible circuit, is inserted within the single-shell or multiple-shell housing of the electric motor, of the drive assembly or in an extension of the body or of the housing of the drive assembly, which extension does not impede parked drive assemblies being moved with respect to one another.

* * * * *